US005909109A

United States Patent [19]

Phillips

[11] Patent Number: 5,909,109

[45] Date of Patent: Jun. 1, 1999

[54] VOLTAGE REGULATOR PREDRIVER CIRCUIT

[75] Inventor: Timothy A. Phillips, Cranston, R.I.

[73] Assignee: Cherry Semiconductor Corporation, East Greenwich, R.I.

[21] Appl. No.: 08/990,689

[22] Filed: Dec. 15, 1997

[51] Int. Cl.[6] ..... G05F 1/573

[52] U.S. Cl. ..... 323/277; 323/274; 323/280; 323/303

[58] Field of Search ..... 323/266, 274, 323/275, 276, 277, 278, 280, 281, 312, 313, 303; 327/540

[56] References Cited

U.S. PATENT DOCUMENTS 4,613,809 9/1986 Skovmand ..... 323/280 X 4,792,747 12/1988 Schroeder ..... 323/303

5,631,598 5/1997 Miranda et al. ..... 327/540

*Primary Examiner*—Peter S. Wong

*Assistant Examiner*—Y. J. Han

*Attorney, Agent, or Firm*—Bromberg & Sunstein LLP

[57] ABSTRACT

A regulator includes a driver stage having an output port for providing an output voltage, a predriver coupled to the driver to control the output voltage provided by the driver stage, a comparator to compare the driver output voltage to a reference voltage, and a feedback element coupled between the driver output port and the comparator. The driver may include a high side transistor having a collector coupled to a collector of a low side transistor, and a current sensing transistor having a base coupled to a base of the low side transistor.

31 Claims, 2 Drawing Sheets

VOLTAGE REGULATOR PREDRIVER CIRCUIT

FIELD OF THE INVENTION

This invention generally relates voltage regulators and, more particularly, this invention relates to predriver circuits for voltage regulators.

BACKGROUND OF THE INVENTION

Dropout voltage in a voltage regulator is defined in the art as the smallest voltage difference that may be permitted between the regulator input and output without adversely affecting regulator performance. As is known in the art, a high dropout voltage is undesirable in most regulators because in addition to requiring a high input voltage, it can increase the temperature of the circuit elements, consequently decreasing the life of the regulator. Accordingly, regulators having a high dropout voltage should not be used in low voltage, low power systems.

Conventional voltage regulators that provide a low dropout voltage (i.e., less than about 1.5 volts) typically must be stabilized by coupling a relatively large capacitor to the regulator output. The capacitor stabilizes the circuit by adding a dominant pole and a zero (to cancel a non-dominant pole) to the frequency response of the regulator circuit.

Use of a capacitor across the output of a voltage regulator is undesirable, however, for a number of reasons. Primarily, it is an extra element that both increases the overall cost of the system, and utilizes a relatively large amount of circuit board space. In addition, although used to stabilize the regulator, the capacitor can destabilize the regulator since it relies upon a number of unstable parasitics for proper performance. Moreover, the capacitor limits the regulator to a small bandwidth, consequently slowing the response time of the regulator.

Exemplary voltage regulators having a low dropout voltage include PNP regulators and composite regulators. PNP regulators operate by sampling the regulator output voltage via a feedback loop, and then comparing the output voltage to a reference voltage. The reference voltage typically is a trimmed bandgap voltage of approximately 1.25 volts. Based upon the comparison of these two voltages, a high gain operational amplifier controls the base-emitter voltage of an NPN transistor, which responsively controls the output current from the collector of a PNP driving transistor to drive a load.

Composite regulators operate in a manner similar to PNP regulators since they include both a PNP regulator circuit, as described above, and a high bandwidth emitter follower circuit that acts as an output driver. As is known in the art, however, composite regulators have AC characteristics that are very similar to those of PNP regulators. Accordingly, like PNP regulators, composite regulators have a low dropout voltage and require a capacitor for stabilization purposes.

Unlike PNP regulators and composite regulators, conventional Darlington regulators typically do not require an external stabilization capacitor but do have a high dropout voltage. Accordingly, because of such high dropout voltage, Darlington regulators should not be used with low voltage, low power systems.

SUMMARY OF THE INVENTION

In accordance with one aspect of the invention, a regulator includes a predriver that provides a low dropout voltage and eliminates the need for an external stabilization capacitor. To that end, the regulator includes a driver stage having an output port for providing an output voltage, a predriver coupled to the driver stage to control the output voltage provided by the driver stage, a comparator to compare the driver output voltage to a reference voltage, and a feedback element coupled between the driver output port and the comparator. The predriver preferably includes a high side transistor having a collector coupled to a collector of a low side transistor, and a current sensing transistor having a base coupled to both a base of the low side transistor and the comparator. In preferred embodiments, the current sensing transistor includes a collector that is coupled to the high side transistor to control the drive current applied to the high side transistor. The predriver also may include a current gain transistor having a base and a collector. In some embodiments, the current gain transistor collector is coupled to a base of the high side transistor to control the base-emitter voltage of the high side transistor, and the current gain transistor base is coupled to a collector of the current sensing transistor.

In another aspect of the invention, the predriver controls the output voltage to the driver stage by including a high side transistor having a collector and a base, a low side transistor having a collector and a base, and a current sensing transistor having a base and a collector. In preferred embodiments, the output is driven by the collector of the high side transistor, and the collector of the high side transistor is coupled to the collector of the low side transistor. In addition, the collector of the current sensing transistor is coupled to the base of the high side transistor to control the drive current applied to the high side transistor, and the base of the current sensing transistor is coupled to the base of the low side transistor.

In accordance with yet another aspect of the invention, the predriver provides a dropout voltage of less than about 1.5 volts between the input of the voltage regulator and the output of the voltage regulator, and also provides one dominant low frequency pole.

BRIEF DESCRIPTION OF THE DRAWINGS

The foregoing and other objects and advantages of the invention will be appreciated more fully from the following further description thereof with reference to the accompanying drawings wherein.

DESCRIPTION OF ILLUSTRATIVE EMBODIMENTS

Figure 1:
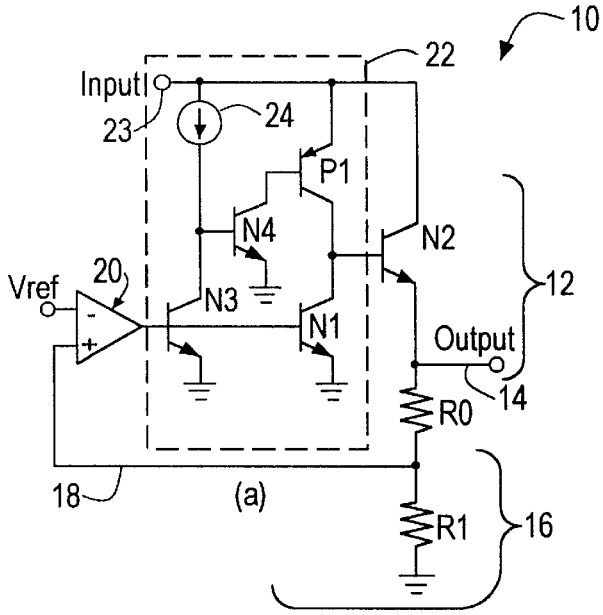
FIG. 1 schematically shows a linear regulator that incorporates a preferred embodiment of the invention.

FIG. 1 schematically shows a linear regulator 10 that incorporates a preferred embodiment of the invention. The linear regulator 10 has a low dropout voltage (i.e., not greater than about 1.5 volts) and does not require (but may include) an external stabilization capacitor across its output. The regulator 10 thus may be effectively utilized in low voltage, low power systems. In preferred embodiments, the regulator 10 is implemented as an integrated circuit.

To that end, the linear regulator 10 includes a driver stage (hereinafter "driver 12") having an output terminal (hereinafter "output port 14"), a feedback stage 16 having a feedback line 18 coupled between the driver output port 14 and a comparator circuit 20, and a predriver 22 for controlling the performance of the driver 12. An input voltage may be applied to an input port 23 to energize the circuit. It should be noted that when describing the regulator 10, two circuit elements may be considered to be "coupled" even if other circuit elements are connected between such two elements.

The comparator circuit 20 preferably is a conventional high gain operational amplifier ("op-amp 20"). The driver 12 preferably includes an NPN bipolar junction (driver) transistor N2 in an emitter follower configuration with its base coupled to the output of the predriver circuit 22. The feedback stage 16 preferably includes a first resistor R0, a second resistor R1. and the feedback line 18 coupled between the two resistors R0 and R1.

The comparator 20 compares the feedback voltage received by the feedback line 18 to a reference voltage which, in preferred embodiments, is about 1.25 volts. As is known in the art, the output voltage of the regulator 10 is a function of the resistance values of the feedback resistors R0 and R1 and the reference voltage. More particularly, the output voltage across the output port 14 may be calculated according the Equation 1 shown below:

$$Vout=Vref(1+R0/R1) \qquad \text{EQUATION 1}$$

The predriver 22 includes several circuit elements that together maintain the output voltage of the driver 12 at a preselected constant value as calculated by Equation 1. More particularly, the predriver 22 includes a low side transistor N1 for controlling the voltage to the driver 12, a current sensing transistor N3 for sensing the current transmitted through the low side transistor N1, and a constant current source 24 for supplying DC bias current to the current sensing transistor N3. The predriver 22 also includes a high side transistor P1 for providing current from the high side voltage (i.e., the input voltage) to the driver transistor N2, and a current gain transistor N4 for controlling the high side transistor P1. In addition to supplying current to the current sensing transistor N3, the current source 24 also provides current to the current gain transistor N4.

In preferred embodiments, the current sensing transistor N3, current gain transistor N4. and low side transistor N1 each are NPN bipolar junction transistors, and the high side transistor P1 is a PNP bipolar junction transistor. As shown in FIG. 1, the bases of the low side transistor N1 and the current sensing transistor N3 both are coupled to the output of the op-amp 20. Furthermore, the collector of the low side transistor N1 is coupled to both the base of the driver transistor N2 and the collector of the high side transistor P1. In addition, the collector of the current sensing transistor N3 is coupled to the base of the current gain transistor N4, both of which also are coupled to the constant current source 24. Finally, the emitter of the high side transistor P1 is coupled to the input voltage, while its base is coupled to the collector of the current gain transistor N4.

Application of an input voltage to the input port 23 initially causes the current gain transistor N4 to turn-on hard, which consequently turns on the high side transistor P1 to cause a high current to flow from the high side transistor P1. Both the low side transistor N1 and current sensing transistor N3, however, still are cut off at this point. All of the current from the high side transistor P1 consequently flows into the driver 12, thereby beginning to raise the output voltage from zero volts. The feedback line 18 feeds the initial voltage to the op-amp 20, which begins energizing the low side transistor N1 and current sensing transistor N3. The current through these two transistors, however, is very low at early powering stages and rises as the output voltage increases toward its preselected value (Equation 1).

As the output voltage increases, the energizing voltage to the low side transistor N1 increases, consequently drawing more current (from the high side transistor P1) away from the driver transistor N2. At the same time, the energizing voltage to the current sensing transistor N3 increases, consequently drawing current (from the current source 24) away from the base of the current gain transistor N4, This causes the current gain transistor N4 to conduct less current to the high side transistor P1, consequently causing the high side transistor P1 to conduct less current toward the driver 12. Accordingly, the combination of the decreasing current from the high side transistor P1 and the increasing current consumption of the low side transistor N1 eventually stabilizes the output voltage at the preselected voltage, thus sufficiently damping the circuit to prevent an overshoot condition. In the steady state, the current through the current sensing transistor N3 is substantially equal to the current through the low side transistor N1 (i.e. the current from the current source 24 less base current of the current gain transistor N4), During operation, a number of factors can temporarily affect the performance and output voltage of the regulator 10. Among those factors is the fluctuating temperature of the circuit elements, changes in input voltage, and the variable number of loads coupled to the output of the regulator 10. The regulator 10 is designed, however, to maintain the output voltage at the preselected value when such factors are presented to the regulator 10. Below are two examples of a fluctuating load affecting regulator performance during the steady state.

In the first example, an additional load is coupled to the output, thereby (slightly) decreasing the output voltage. The comparator 20 consequently subtracts the reference voltage from the new (lower) output voltage, thus applying a lower voltage to the respective bases of the low side transistor N1 and the current sensing transistor N3. In response, the low side transistor N1 draws less current from the high side transistor P1, consequently causing additional current to be drawn into the base of the driver transistor N2. In a similar fashion, the decreased base voltage of the current sensing transistor N3 causes it to draw less current from the current source 24, thus causing additional current to be drawn into the current gain transistor N4. The current gain transistor N4 consequently increases the base-emitter voltage of the high side transistor P1, thereby causing the high side transistor P1 to conduct additional current toward the driver transistor N2. The combination of the increased current flow from the high side transistor P1 and the decreased current being drawn by the low side transistor N1 together increase the output voltage to the preselected level.

In the second example, a load is removed from the output, thereby (slightly) increasing the output voltage. The comparator 20 consequently subtracts the reference voltage from the new (increased) voltage, thereby applying a higher voltage to the bases of the low side transistor N1 and the current sensing transistor N3. In response, the low side transistor N1 draws more current from the high side transistor P1, consequently causing less current to be supplied to the driver 12. In similar fashion, the increased base voltage of the current sensing transistor N3 causes it to draw more current from the current source 24, thus causing less current to be drawn into the current gain transistor N4. The current gain transistor N4 consequently decreases the baseemitter voltage of the high side transistor P1, thereby causing the high side transistor P1 to conduct less current toward the driver 12. The combination of the decreased current flow from the high side transistor P1 and the increased current being drawn by the low side transistor N1 together decrease the output voltage to the preselected level.

Figure 2:
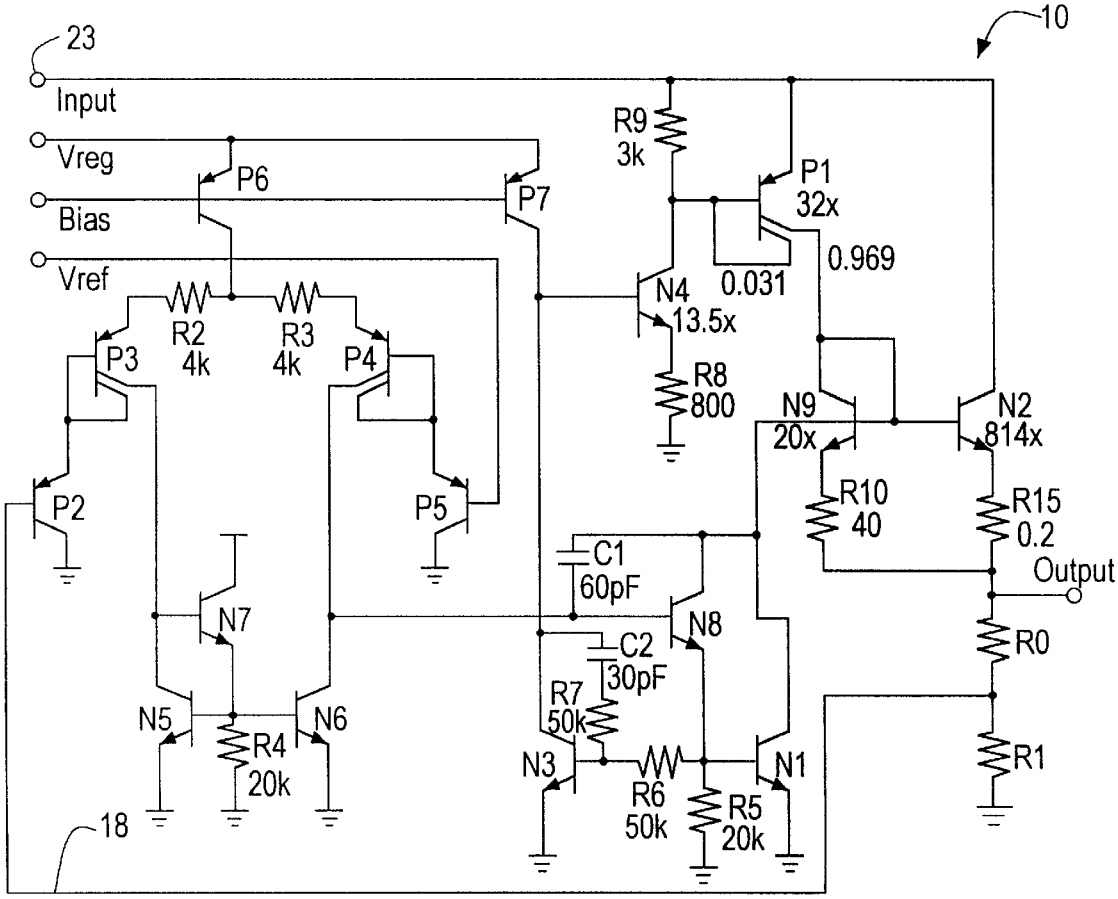
FIG. 2 is a more detailed schematic drawing of the regulator shown in FIG. 1.

FIG. 2 is a more detailed schematic drawing of a preferred embodiment of the regulator 10 shown in FIG. 1. It should be noted, however, that the regulator 10 shown in FIG. 1 may be implemented in other known configurations and thus, the arrangement of the circuit elements in FIG. 2 should not be considered to limit the scope of the regulator 10 shown in FIG. 1.

The op-amp 20 preferably is a differential amplifier comprised of PNP bipolar junction transistors designated as P2, P3, P4, and P5, NPN bipolar junction transistors designated as N5, N6, and N7, and resistors R2, R3, and R4, As noted above, the op-amp 20 amplifies the voltage difference between the reference voltage and the voltage provided by the feedback line 18. This amplified voltage difference is applied to the predriver 22 to control the output voltage of the driver 12.

The predriver 22 comprises NPN bipolar junction transistors identified as N1, N3, N4, and N8, PNP bipolar junction transistor P1 capacitors C1 and C2, and resistors R5, R6, R7, R8, and R9. The driver 12 comprises NPN bipolar junction transistors identified as N9 and N2, and resistors R10 and R15. Values of the listed elements maybe as follows:

R2: 4K ohms;

R3: 4K ohms;

R4: 20K ohms;

R5: 20K ohms:

R6: 50K ohms;

R7: 50K ohms;

R8: 800 ohms;

R9: 3K ohms;

R10: 40 ohms;

R15: 0.2 ohms;

R0: 21.96K ohms:

R1: 4K ohms;

C1: 60 picofarads;

C2: 30 picofarads;

P1: 32X;

N2: 814X;

N4: 13.5X; and

N9: 20X.

Capacitor C1 internally provides pole compensation (i.e., provides one dominant low frequency pole) by splitting two poles produced by the regulator 10. In the regulator 10 shown in FIG. 2, a first pole is moved by the capacitor C1 to about 9 Hertz by making the time constant at the base of N8 large through Miller multiplication of the capacitor C1 (Miller multiplication is a commonly known theory of electronics). A second pole also is moved by the capacitor C1 to about 1.1 Megahertz by selecting the impedance to AC ground at the collector of transistor N8 to be small, which consequently causes the time constant to be small.

Figure 3:
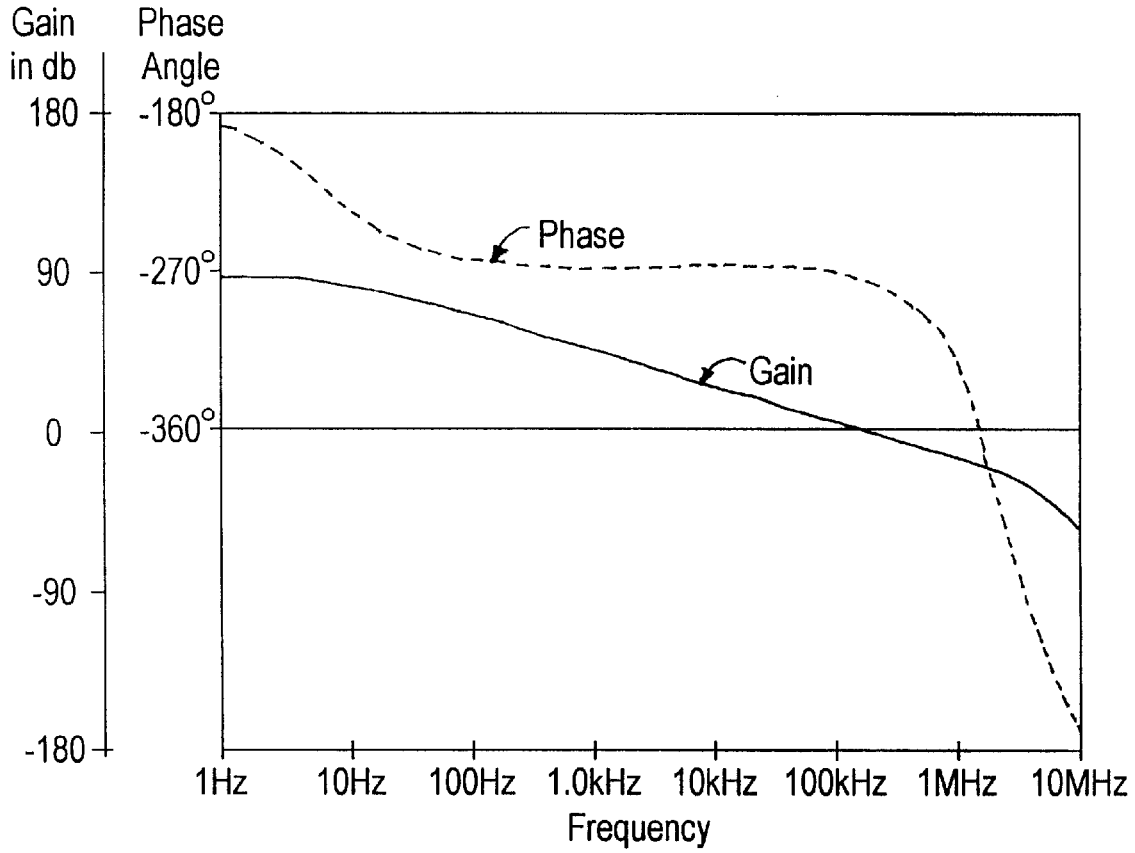
FIG. 3 graphically shows the gain and phase curves of the regulator shown in FIG. 2.

FIG. 3 graphically shows the gain and phase curves of the regulator 10 shown in FIG. 2. The graph shows that the regulator 10 has one dominant low frequency pole. Other poles are at much higher frequencies and thus, do not adversely affect regulator 10 performance. More particularly, there is greater than an eighty degree phase margin and therefore, the regulator 10 is sufficiently damped to act as a single pole amplifier.

Figure 4:
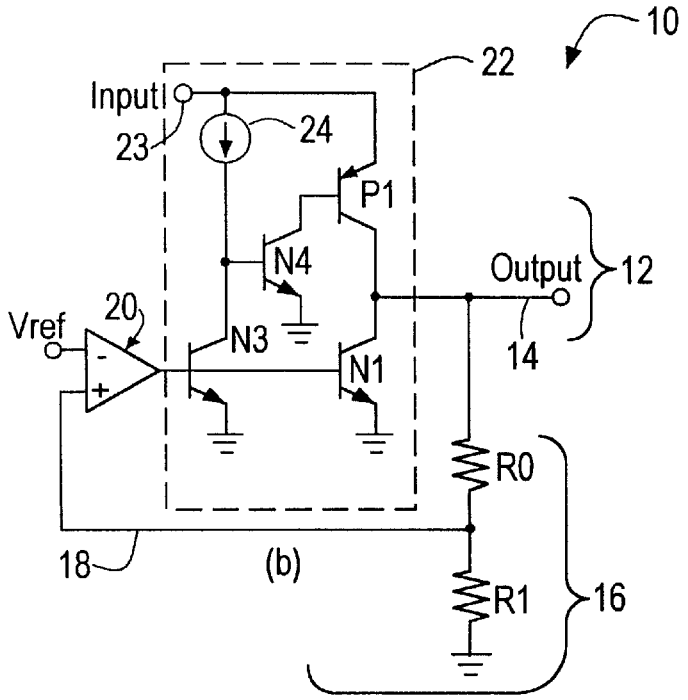
FIG. 4 schematically shows an alternative embodiment of the regulator shown in FIG. 1.

FIG. 4 schematically shows an alternative embodiment of the regulator 10 shown in FIG. 1 in which the drive transistor N2 is omitted. Accordingly, the driver 12 stage does not include a driver transistor N2 and the output port 14 is across the intersection point of the collector of the low side transistor N1, and the collector of the high side transistor P1. If the circuit elements are properly selected, this embodiment of the invention should have a lower dropout voltage (i.e., about one volt) than that of the embodiment shown in FIG. 1. As shown below, the alternative regulator 10 shown in FIG. 4 operates substantially identically to the regulator 10 shown in FIG. 1.

In particular, application of an input voltage to the input port 23 initially causes the current gain transistor N4 to turn-on hard, which consequently turns on the high side transistor P1 and causes a high current to flow from the high side transistor P1. The output voltage thus rises with the collector-emitter voltage of the high side transistor P1. Both the low side transistor N1 and current sensing transistor N3, however, still are cut off at this point. All of the current from the high side transistor P1 consequently flows to output port 14. The feedback line 18 feeds the initial voltage to the op-amp 20, which begins energizing the low side transistor N1 and current sensing transistor N3.

As the voltage applied to the low side transistor N1 increases, more current is drawn (from the high side transistor P1) away from the output. The collector-emitter voltage of the low side transistor N1 consequently increases, thus lowering the output voltage of the driver 12. At the same time, the energizing voltage to the current sensing transistor N3 increases, thus drawing current to the current sensing transistor N3 from the current source 24, consequently decreasing the current flow into the base of the current gain transistor N4. This causes the current gain transistor N4 to conduct less current to the high side transistor P1, consequently causing the high side transistor P1 to conduct less current and lowering the collector-emitter voltage across the high side transistor P1. Accordingly, the combination of the decreasing current from the high side transistor P1 and the increasing current consumption of the low side transistor N1 eventually stabilizes the output voltage at the preselected voltage. In the steady state, the current through the current sensing transistor N3 is substantially equal to that through the low side transistor N1 (i.e., the current from the current source 24 less base current of the current gain transistor N4).

Below are two examples of a fluctuating load affecting performance of the alternative regulator 10 during the steady state. As noted above, other factors can affect regulator performance during operation.

In the first example, an additional load is coupled to the output, thereby (slightly) decreasing the output voltage. The comparator 20 consequently subtracts the reference voltage from the new (lower) output voltage, thus applying a lower voltage to the respective bases of the low side transistor N1 and the current sensing transistor N3. In response, the low side transistor N1 draws less current from the high side transistor P1, consequently causing additional current to be drawn into the output port 14 and decreasing its collector-emitter voltage. In a similar fashion, the decreased base voltage of the current sensing transistor N3 causes it to draw less current from the current source 24, thus causing additional current to be drawn into the current gain transistor N4. The current gain transistor N4 consequently increases the base-emitter voltage of the high side transistor P1, thereby causing the high side transistor P1 to conduct additional current toward the output port 14 and to increase its collector-emitter voltage. The combination of the increased current flow (i.e., increased collector-emitter voltage) from the high side transistor P1 and the decreased current (i.e., decreased collector-emitter voltage) being drawn by the low side transistor N1 together increase the output voltage to the preselected level.

In the second example, a load is removed from the output, thereby (slightly) increasing the output voltage. The comparator 20 consequently subtracts the reference voltage from the new (increased) voltage, thereby applying a higher voltage to the bases of the low side transistor N1 and the current sensing transistor N3. In response, the low side transistor N1 draws more current from the high side transistor P1, consequently causing less current to be supplied to the output port 14 and increasing its collector-emitter voltage. In similar fashion, the increased base voltage of the current sensing transistor N3 causes it to draw more current from the current source 24, thus causing less current to be drawn into the current gain transistor N4. The current gain transistor N4 consequently decreases the base-emitter voltage of the high side transistor P1, thereby causing the high side transistor P1 to conduct less current toward the output port 14 and decreasing its collector-emitter voltage. The combination of the decreased current flow (i.e., decreased collector-emitter voltage) from the high side transistor P1 and the increased current (i.e., increased collector-emitter voltage) being drawn by the low side transistor N1 together decrease the output voltage to the preselected level.

The linear regulators 10 shown in FIGS. 1, 2, and 4 thus do not require external stabilization capacitors and have a low dropout voltage. Accordingly, the regulator 10 shown in FIGS. 1, 2, and 4 operate stably, have a large bandwidth and relatively rapid response times, have an extended lifetime, and are relatively inexpensive to manufacture and operate.

In alternative embodiments, the regulators 10 shown in FIGS. 1, 2, and 4 may be implemented with similar electronic components. For example, p-channel metal oxide semiconductor field effect transistors (MOSFETs) may be utilized instead of the PNP bipolar junction transistors. In a similar manner, n-channel MOSFETs may be utilized instead of the NPN bipolar junction transistors.

Although various exemplary embodiments of the invention have been disclosed, it should be apparent to those skilled in the art that various changes and modifications can be made which will achieve some of the advantages of the invention without departing from the true scope of the invention. These and other obvious modifications are intended to be covered by the appended claims.

I claim:

1. A predriver for controlling an output to a driver, the predriver comprising:

a high side transistor having a base and a collector, the output being driven by the collector of the high side transistor;

a low side transistor having a base and a collector, the collector of the high side transistor being coupled to the collector of the low side transistor; and a current sensing transistor having a base and a collector, the base of the current sensing transistor being coupled to the base of the low side transistor, the collector of the current sensing transistor coupled to the base of the high side transistor to control the drive current applied to the high side transistor.

2. The predriver as defined by claim 1 wherein the current sensing transistor has an emitter that is coupled to an emitter of the low side transistor.

3. The predriver as defined by claim 1 wherein the predriver is used with a regulator, the regulator having a comparator and a feedback element coupled between the output of the driver and the comparator.

4. The predriver as defined by claim 3 wherein the feedback element includes a first resistor, a second resistor, and a feedback line extending from between the first and second resistors to the comparator.

5. The predriver as defined by claim 1 wherein the driver is an NPN bipolar junction transistor.

6. The predriver as defined by claim 1 further including a current source coupled to a collector of the current sensing transistor.

7. The predriver as defined by claim 1 further including a current gain transistor having a collector and a base, the base of the current gain transistor being coupled to the collector of the current sensing transistor, the collector of the current gain transistor being coupled to a base of the high side transistor to control the drive current applied to the high side transistor.

8. The predriver as defined by claim 1 wherein the high side transistor is a PNP bipolar junction transistor.

9. A regulator having an output port, the regulator comprising:

a predriver coupled to the output port to control the output voltage at the output port;

a comparator to compare the output voltage to a reference voltage; and a feedback element coupled between the output port and the comparator;

the predriver comprising a high side transistor having a collector coupled to a collector of a low side transistor, and a current sensing transistor having a base coupled to a base of the low side transistor and coupled to the comparator, the current sensing transistor also including a collector that is coupled to the high side transistor to control the drive current applied to the high side transistor.

10. The regulator as defined by claim 9 wherein the predriver further includes a current gain transistor having a base and a collector, the current gain transistor base being coupled to a collector of the current sensing transistor, the current gain transistor collector being coupled to a base of the high side transistor to control the base-emitter voltage of the high side transistor.

11. The regulator as defined by claim 9 further including a driver stage coupled between the predriver and the output port.

12. The regulator as defined by claim 11 wherein the driver stage includes an NPN bipolar junction transistor.

13. The regulator as defined by claim 9 wherein the output port is coupled to the collector of the high side transistor.

14. The regulator as defined by claim 9 wherein the feedback element includes a first resistor coupled to a second resistor, and a feedback line extending from between the first and second resistors and the comparator.

15. The regulator as defined by claim 9 further including a current source coupled to the current sensing transistor.

16. The voltage regulator as defined by claim 9 wherein the high side transistor is a PNP bipolar junction transistor.

17. The voltage regulator as defined by claim 9 wherein the current sensing transistor includes an emitter that is coupled to an emitter of the low side transistor.

18. A regulator having an output port, the regulator comprising:

a predriver coupled to the output port to control the output voltage at the output port;

a comparator to compare the output voltage to a reference voltage; and a feedback element coupled between the output port and the comparator;

the predriver comprising a high side transistor having a base and a collector, a current gain transistor having a base and a collector, and a current sensing transistor having a base and a collector, the current sensing transistor base being coupled to the comparator, the current sensing transistor collector being coupled to the current gain transistor base, the current gain transistor collector being coupled to the high side transistor base to control the drive current applied to the high side transistor, the high side transistor collector being coupled to the output port.

19. The regulator as defined by claim 18 wherein the predriver further includes a low side transistor having a base coupled to the base of the current sensing transistor.

20. The regulator as defined by claim 19 wherein the low side transistor has a collector coupled to the collector of the high side transistor.

21. The regulator as defined by claim 18 wherein the high side transistor is a PNP bipolar junction transistor.

22. The regulator as defined by claim 18 wherein the predriver further includes a current source coupled to the base of the current gain transistor.

23. The regulator as defined by claim 18 further including a driver stage coupled between the predriver and the output port.

24. The regulator as defined by claim 23 wherein the driver stage comprises a driver transistor.

25. A regulator having an input terminal and an output terminal, the regulator comprising:

a predriver for controlling an output voltage applied to the output terminal;

a comparator;

a feedback element coupled between the output terminal and the comparator;

the predriver having means for providing a dropout voltage of less than about 1.5 volts between the input terminal of the regulator and the output terminal of the regulator, the predriver also having means for providing one dominant low frequency pole.

26. The regulator as defined by claim 25 wherein the predriver includes a high side transistor coupled to a low side transistor, and means for sensing the current through the low side transistor.

27. The regulator as defined by claim 26 wherein the sensing means includes a current sensing transistor.

28. The regulator as defined by claim 26 wherein the predriver includes means for controlling the drive current applied to the high side transistor.

29. The regulator as defined by claim 28 wherein the controlling means includes a current gain transistor.

30. The regulator as defined by claim 25 wherein the comparator includes a positive terminal and a negative terminal, further wherein the feedback element includes a line coupled between the output terminal and the negative terminal of the comparator.

31. The regulator as defined by claim 25 wherein the means for providing dropout voltage includes means for providing a dropout voltage of less than about one volt.

* * * * *